US006656649B1

(12) United States Patent
Ohishi et al.

(10) Patent No.: US 6,656,649 B1
(45) Date of Patent: Dec. 2, 2003

(54) RECORDING MATERIAL FOR ELECTROPHOTOCOPY AND IMAGE RECORDING METHOD

(75) Inventors: Yasushi Ohishi, Tokyo (JP); Seiichi Kubodera, Minami-ashigara (JP); Kouzou Satoh, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 176 days.

(21) Appl. No.: 09/670,718

(22) Filed: Sep. 28, 2000

(30) Foreign Application Priority Data

Sep. 28, 1999 (JP) ..... 11/274592

(51) Int. Cl.[7] ..... G03G 13/20
(52) U.S. Cl. ..... 430/56; 430/108.1; 430/124
(58) Field of Search ..... 430/56, 124, 108.1

(56) References Cited

U.S. PATENT DOCUMENTS 4,121,932 A * 10/1978 Ishida ..... 96/1.2
4,590,142 A * 5/1986 Yamazaki et al. ..... 430/138
5,683,843 A * 11/1997 Nohr et al. ..... 430/108.5

* cited by examiner

*Primary Examiner*—John Goodrow
(74) *Attorney, Agent, or Firm*—Sughrue Mion, PLLC

(57) ABSTRACT

The present invention provides a recording material for electrophotography capable of forming a highly qualified image in which color reproducibility, recording density and smoothness of a recording surface are improved.

A recording material for electrophotography comprising a toner containing a coloring matter, and a recording medium for electrophotography wherein a toner-receiving layer, which contains a resin capable of fixing the coloring matter contained in said toner, is placed on a support, characterized in that said material contains a coloring matter-fixing agent capable of fixing the coloring matter in the toner and/or the toner-receiving layer.

21 Claims, No Drawings

RECORDING MATERIAL FOR ELECTROPHOTOCOPY AND IMAGE RECORDING METHOD

BACKGROUND OF THE INVENTION

1. Field of the Invention

The present invention relates to a recording material for electrophotography and an image recording method. More specifically, the present invention relates to a recording material for electrophotography capable of forming a highly qualified image in which color reproducibility, recording density and smoothness of a recording surface are improved, and a degradation of image quality due to discoloration and bleeding is rarely occurred during storage.

2. Description of Related Art

An electrophotographic method is an image forming method applying a photoconductive effect and an electrostatic phenomenon, and the method is widely utilized in a variety of fields. The electrophotographic method has two kinds: one is to form an image on a semiconductor material itself such as zinc oxide paper; the other is to form an image by further transferring a toner image from the semiconductor material to a recording medium capable of receiving toner images. The latter, called a xerography method, is widely employed in copying machines for offices, and the image forming principle thereof is described below.

First, electrostatic charges are placed in the dark on a photosensitive plate having a photoconductor such as selenium by using corona charge or the like, and when the charged plate is exposed to an original image, charges are changed only in the irradiated parts to form a latent image. Charged toners, after mixed with carriers and introduced to the latent image, are adhered in an image-form. Then, the recording medium is applied thereon to transfer the toner to the recording medium, and then fixed the toner by heating or the like to form an image.

In recent years, color-copying machines are further widely used, and those color copying machines carry out the aforementioned method by utilizing color toners. Because the color copying machines are mostly used for copying images rather than letters, the images to be formed are sought to be clear and highly qualified. However, when color copying is intended to make on a plain paper, clear and highly qualified images cannot be achieved. Thus, it has been sought to improve recording materials.

The color toners used in such an electrophotographic method generally comprise particles prepared by dispersing a coloring matter such as a dye and a pigment into a thermoplastic resin; and the average diameter of the particles typically ranges from around 5 to 20 $\mu$m. A great variety of coloring matter is used in the toner; its stability in the toner-receiving layer after image forming is not always satisfactory. Thus, the image formed by the electrophotographic method has disadvantages in that a degradation of image quality due to discoloration and bleeding is worsened during storage.

Meanwhile, it has recently been sought to store a highly qualified image for a long period. Thus, it is sought to develop a technique that can store a highly qualified image close to a silver salt photograph without degradation.

SUMMARY OF THE INVENTION

It is an object of the invention to eliminate the aforementioned problems of the prior art. In other words, the invention provides, as an object to be accomplished, a recording material for electrophotography and an image recording method capable of forming a highly qualified image in which color reproducibility, recording density and smoothness of a recording surface are improved. The invention further provides, as another object to be accomplished, a recording material for electrophotography and an image recording method in which a degradation of image quality after a long period storage is reduced.

The inventors diligently studied to solve the above problems, and found that, when a coloring matter is fixed after forming an image, a highly qualified image can be retained for a long period, and therefore the invention has been reached.

This invention provides a recording material for electrophotography comprising a toner containing a coloring matter, and a recording medium for electrophotography wherein a toner-receiving layer which contains a resin capable of fixing the coloring matter contained in said toner is placed on a support, characterized in that said material contains a coloring matter-fixing agent capable of fixing the coloring matter in the toner and/or the toner-receiving layer. It is preferred that the coloring matter has a function of fixing the coloring matter by heating.

The preferred combinations of a coloring matter and a coloring matter-fixing agent used in this recording material for electrophotography can illustrate; those which said coloring matter-fixing agent can react with the coloring matter by the Diels-Alder reaction; those which said coloring matter-fixing agent is a metal ion or a compound capable of providing the metal ion, and said coloring matter is a compound which forms a chelate with the metal ion; those which said coloring matter-fixing agent is an acidic material or an acidic polymer, and said coloring matter is a basic compound or a compound having a basic group; those which said coloring matter-fixing agent is a basic material or a polymeric mordant having a basic group, and said coloring matter is a compound having an acidic dissociating group; those which said coloring matter-fixing agent is a high-molecular weight nucleophilic compound, and said coloring matter is a compound having an electrophilic center; those which said coloring matter is a compound in which an electrophilic group is coupled with in its molecule, and said coloring matter-fixing agent is a high-molecular weight amine compound which reacts with the compound; those which said coloring matter-fixing agent is a polymeric compound having an active hydrogen, and said coloring matter is a compound in which an electrophilic aziridine group and epoxy group is introduced; those which the coloring matter-fixing agent is a thermo-polymerization initiator, and the coloring matter is a compound having a polymerizable group in its molecule; and those which the coloring matter is a deprotonated cationic compound, and the coloring matter-fixing agent is a compound capable of re-protonating said deprotonated compound.

A resin used in the recording medium for electrophotography is preferably a thermoplastic resin having a temperature of flow beginning (Tfb) of 100° C. or less; and also it is preferred that the resin is comprised of the same polymer as a resin constituting the toner. It is preferred that the recording medium for electrophotography and the toner contain an anti-discoloring agent and/or an UV absorbent. Further, it is preferred that the toner is prepared by milling a resin containing a coloring matter at 0° C. or less, or by a polymerization method.

Alternatively, the present invention provides a toner for electrophotography characterized in that said toner contains a coloring matter and a coloring matter-fixing agent capable of fixing the coloring matter. Further, the present invention provides a recording medium for electrophotography wherein a toner-receiving layer, which contains a resin capable of fixing the coloring matter, is placed on a support, characterized in that said medium contains a coloring matter-fixing agent capable of fixing the coloring matter in the toner-receiving layer.

The present invention provides an image recording method comprising: forming a toner image containing a coloring matter that constitutes the same recording material for electrophotography on a recording medium for electrophotography that constitutes the recording material for electrophotography, and fixing the coloring matter by means of the coloring matter-fixing agent contained in the toner-receiving layer. It is preferred that a fixation is carried by heating.

DESCRIPTION OF THE PREFERRED EMBODIMENTS

In addition to a specific explanation of a constitution of a recording material for electrophotography of the invention, an image recording method of the invention will be explained in detail hereinafter.

The image recording material for electrophotography of the invention comprises a toner containing a coloring matter, and a recording medium for electrophotography. The recording medium for electrophotography is that contains, on a support, a resin capable of fixing the coloring matter contained in the toner. The characteristics of the recording material for electrophotography of the invention are that a coloring matter-fixing agent fixing a coloring matter is contained in the toner and/or a toner-receiving layer.

In the support used in the image medium for electrophotography, which constitutes the invention, types thereof are not especially limited as long as those are made of a material, which can be generally used for an electrophotography. Especially, any material may be used as long as the support can resist a fixing temperature, and satisfy such requirements as smoothness, whiteness, slippery properties, friction, antistatic properties, or hollows after fixation or the like. Generally, supports for electrophotography such as papers, synthetic polymers (films) or the like can be used as described in "Shashinkogaku no Kiso-Ginen" pp. 223 to 240, ed. Nihon Shyasin Gakkai (Corona Publishing Co., Ltd, 1979). Specific examples to be used include paper supports such as synthetic papers (polyolefin-, polystyrene-synthetic papers), high quality papers, art papers, (double-sided) coated papers, (double-sided) cast-coated papers, mixed paper produced from synthetic resin pulp such as polyethylene or the like and natural pulp, yankee papers, baryta papers, wallpapers, guard papers, synthetic resin or emulsion impregnated papers, synthetic rubber latex impregnated papers, synthetic resin-innerly added papers, paperboards, cellulose fiber papers, polyolefin coated papers (especially coated on the both sides with polyethylene) or the like; various plastic films or sheets such as polyolefin, polyvinyl chloride, polyethylene terephthalate, polystyrene metacrylate, polyethylene naphthalate, polycarbonate, polyvinyl chloride, polystyrene, polypropylene, polyimide, celluloses (for example, triacetyl cellulose) or the like; and the films and sheets of aforementioned plastics subjected to treatments for providing reflecting properties (for example, a treatment for providing a film with pigment such as titanium oxide); cloth, metals, glasses or the like. These can be used alone, or used as a support laminated on one side or both sides with synthetic polymers such as polyethylene or the like. Also, a laminate support formed by any combination of the above supports can be used. Other supports described in Japanese Unexamined Patent Publication (KOKAI) Showa No. 62-253159; pp. 29 to 31, Japanese Unexamined Patent Publication (KOKAI) Heisei No. 1-61236; pp. 14 to 17, Japanese Unexamined Patent Publication (KOKAI) Showa No. 63-316848, Japanese Unexamined Patent Publication (KOKAI) Heisei No. 2-22651, Japanese Unexamined Patent Publication (KOKAI) Heisei No. 3-56955, and U.S. Pat. No. 5,001,033 can be used. These can be selected depending on the purpose of use and the use condition. It is possible to use a transparent support for an OHP.

Among others, it is preferred that a support which is paper-made from a pulp stuff and which has a density defined-in JIS P8118 of 0.90 g/cm$^3$ or more. Examples of these pulp stuff include Broad-Leaved Tree Bleached Kraft Pulp (LBKP), Needle-Leaved Tree Breached Kraft Pulp (NLKP), Broad-Leaved Tree Sulfite Pulp (LBSP) and the like. These can be used alone, or in combination with one another. Preferably, the pulp stuff has a weight average fiber length of from 0.45 to 0.65 mm, and especially preferably from 0.50 to 0.60 mm after beating.

If necessary, various types of additives including a filler, a dry paper power enhancer, a sizing agent, a wet paper power enhancer, a fixing agent, a pH conditioner and other agents can be suitably added to the support such as said pulp stuff (also referred to "a pulp slurry").

Examples of the above filler include calcium carbonate, clay, kaolin, china clay, talc, titanium oxide, diatomaceous earth, barium sulfate, aluminum hydroxide, magnesium hydroxide and the like.

Examples of the above dry paper power enhancer include cationized starch, cationized polyacrylamide, anionized polyacrylamide, carboxy modified polyvinyl alcohol and the like.

Examples of the above sizing agent include aliphatic acid salts, rosins, rosin derivatives such asmaleic rosins, paraffinic wax, alkyl ketene dimer, alkenyl succinic acid anhydride (ASA) and the like.

Examples of the above wet paper power enhancer include polyamine polyamide epichlorohydrin, melamine resin, urea resin, epoxylated polyamide resin and the like.

Examples of the above fixing agent include polyvalent metal salts such as aluminum sulfate, aluminum chloride and the like, as well as a cationic polymer such as a cationized starch.

Examples of the above pH conditioner include caustic soda, sodium carbonate ant the like.

Examples of the other agents include anti-foaming agent, dye, pigment, slime controlling agent, fluorescent whitener, softening agent, electrically-conductive agent and the like.

These supports have generally a thickness of from 20 $\mu$m to 1000 $\mu$m, preferably from 20 $\mu$m to 800 $\mu$m, more preferably from 25 $\mu$m to 300 $\mu$m, especially preferably from 50 $\mu$m to 260 $\mu$m, and most preferably from around 75 $\mu$m to 220 $\mu$m. Further, the supports having various types of hardness can be used depending on its purpose; and a support having the hardness close to that for a color silver salt photography can be preferably used as an image-receiving paper for photo image quality. Smoothness is the same as above.

In addition, from the viewpoint of fixation properties, it is preferred that a support has a heat transfer rate of a paper of 0.50 kcal/m·h·° C. or more under the condition at 20° C. and RH of 65%. Heat transfer rate can be obtained by measuring a transfer paper conditioned based on JIS P 8111 according to a method described in Japanese Unexamined Patent Publication (KOKAI) Showa No. 53-66279. Further, it is preferred that a support has a density of 0.7 g/cm$^3$ or more from the above viewpoint.

Moreover, one side or both sides of the supports can be subjected to various types of surface treatments or base coatings for improving adhesion to the layer to be formed on the support. The surface treatments include, for example, printing processing for micro fine surfaces, matte surfaces or gloss surfaces as described in Japanese Unexamined Patent Publication (KOKAI) Showa No. 55-26507, as well as activation processings such as corona discharge processing, flame processing, glow discharge processing or plasma processing. As a base coating, the method described in Japanese Unexamined Patent Publication (KOKAI) Showa No. 61-846443, for example, can be utilized. These processings may be carried out alone, or arbitrarily combined together such that activation processing is made after printing process, or base coating is further made after surface treatment such as activation processing.

In the structure of these supports, at the surfaces or back surfaces and in those combinations, semiconductive metal oxides such as hydrophilic binder, aluminasol, or tin oxide; and other antistatic agents such as carbon black may be applied. Specifically, the support described in Japanese Unexamined Patent Publication (KOKAI) Showa No. 63-220246 can be used.

Preferably, the support used in the recording medium for electrophotography include those that one side or both sides of the pulp stuff is coated with a polyolefin resin. This polyolefin resin-coating layer may be a single layer structure, or a laminate structure constituted from more than two layers.

Examples of the polyolefin resin used in said coating layer can be suitably selected from those which can be melt-extruded at a temperature of from 170° C. to 345° C.; examples thereof include a homopolymer of α-olefins such as polyethylene, polypropylene and polybutene, or mixtures thereof. Among others, polyethylene is preferred both in aptitudes of melt extrusion and costs.

Examples of the above polyethylene include any of High Density Polyethylene (HDPE) having a density of from 0.940 to 0.970 g/cm$^3$, Low Density Polyethylene having a density of from 0.910 to 0.930 g/cm$^3$, Linear Low Density Polyethylene (L-LDPE) and the like. In a case when a stiffness of a recording sheet is important, it is preferred to use polypropylene, said High Density Polyethylene (HDPE), Linear Low Density Polyethylene (L-LDPE), mixtures thereof and the like.

The above polyethylene has preferably a melt index of from around 0.1 to 30 g/10 minutes.

Preferably, the support for the recording medium for electrophotography is that said pulp stuff is used and coated on both sides of the pulp stuff with said polyolefin resin after subjected to activation processings such as corona discharge processing, flame processing, glow discharge processing or plasma processing. Preferably, the coating layer of polyolefin resin has generally a thickness of from around 5 to 60 μm, preferably from 15 to 30 μm, when the coating layer is formed into a single layer.

The recording medium for electrophotography used in the invention has a toner-receiving layer of a single or a laminate on a support. The toner-receiving layer is utilized to receive a color or a black toner in order to form an image. The thickness of the toner-receiving layer is preferably ½ or more of the toner particle diameter, and more preferably from 1 to 3 times of the toner particle diameter. Specifically, it is from around 0.5 to 50 μm, and preferably from 2 to 20 μm. Preferable toner-receiving layer include those that have a thickness disclosed in Japanese Unexamined Patent Publication (KOKAI) Heisei No. 5-216322 and Japanese Unexamined Patent Publication (KOKAI) Heisei No. 7-301939. The toner-receiving layer requires to be formed on at least one sides of the support. When it is intended to form an image on both sides of the recording medium for electrophotography, the toner-receiving layer may be formed on both sides of the support.

The toner-receiving layer of the recording medium for electrophotography comprises a resin capable of fixing a coloring matter that is contained in the toner, with preference given to a thermoplastic resin. Specific examples of the resin are polymers including polymer having ester linkages; polyurethane resin; polyamide such as urea resin or the like; polysulfone resin; polyvinyl chloride resin, polyvinylidene chloride resin, vinyl chloride-vinyl acetate copolymer resin, vinyl chloride-propionic acid vinyl copolymer resin; polyol resin such as polyvinyl butyral or the like; cellulose resin such as ethyl cellulose resin, cellulose acetate resin or the like; polycaprolactone resin, styrene-maleic anhydride resin, polyacrylonitrile resin, polyether resin, epoxy resin, phenol resin; polyolefin resin such as polyethylene resin, polypropylene resin or the like, copolymer resin of olefin such as ethylene, propylene or the like with other vinyl monomers, acrylic resin, or the like. These resins may be used alone, or as mixtures or a copolymer in combination with one another.

Among the abovementioned resins, it is preferred to use a polymer similar to a binder polymer of the toner. For example, when the binder polymer of the toner is polyester, a resin having an ester linkage is preferably used. The resin having anester linkage may be obtained by synthesis; or a commercially available product may be used as it is. Specific examples thereof are polyester resin obtained by a condensation of dicarboxylic acid components (sulfonic acid group, carboxyl group or the like can be substituted in these dicarboxylic acid components) such as terephthalic acid, isophthalic acid, maleic acid, fumaric acid, phthalic acid, adipic acid, sebacic acid, azelaic acid, abietic acid, succinic acid or the like, with alcohol components (hydroxy group or the like can be substituted in these alcohol components) such as ethylene glycol, diethylene glycol, propylene glycol, bisphenol A, bisphenol S, 2-ethyl cyclohexyl dimethanol, neopentyl glycol or the like; polyacrylic acid ester resin or polymethacrylic acid ester resin such as polymethyl methacrylate, polybutyl methacrylate, polymethyl acrylate, polybutyl acrylate or the like; polycarbonate resin; polyvinyl acetate resin; styrene acrylate resin, styrene-methacrylic acid ester copolymer resin, vinyl toluene acrylate resin; or the like. Specific examples include those that described respectively in Japanese Unexamined Patent Publication (KOKAI) Showa No. 59-101395, Japanese Unexamined Patent Publication (KOKAI) Showa No. 63-7971, Japanese Unexamined Patent Publication (KOKAI) Showa No. 63-7972, Japanese Unexamined Patent Publication (KOKAI) Showa No. 63-7973, and Japanese Unexamined Patent Publication (KOKAI) Showa No. 60-294862. Following commercial products can be used such as VYLON 200, VYLON 103, VYLON 300, VYLON 500, VYLON 280, and VYLON 290 manufactured by Toyobo Co. Ltd., CHEMIT K-1089, CHEMIT K-1294, CHEMIT R-70, CHEMIT R-80 manufactured by Toray Co. Ltd., Elitel UE-34000, Elitel UE-3221, Elitel UE-3210, Elitel UE-3200 manufactured by Unitika Ltd., Polyester TP-220, Polyester TP290, Polyester HP320 and Polyester SP-13L manufactured by Nippon Synthetic Chemical Industry Co., Ltd, ATR-2009, ATR-2010, TUFTONE NE382 manufactured by Kao Corporation or the like.

It is preferred to use a polyester resin in combination with an isocyanate compound in the toner-receiving layer. There is no limitation with respect to the types of the isocyanate compound used in the toner-receiving layer. The isocyanate compound preferably has a molecular weight of from 200 to 2000. It is especially effective for preventing a thermal infusion to proceed a reaction which form an urea linkage by reacting an isocyanate compound with water; a reaction which form a biuret linkage by further reacting the urea linkage with an isocyanate compound; or a reaction which form an uretdione ring or isocyanurate ring by reacting between isocyanate compounds, in the toner-receiving layer, using polyester resin in combination with the isocyanate compound.

In order to form a urea linkage, a biuret linkage, an uretdione ring, and an isocyanurate ring by a reaction in the toner-receiving layer, a triisocyanate compound is preferable than a diisocyanate compound. Specific examples of a triisocyanate compound include trimethylol propane modified tolylene diisocyanate, trimethylol propane modified hexamethylene diisocyanate, isocyanurate linked tolylene diisocyanate, isocyanurate linked hexamethylene diisocyanate, biuret linked hexamethylene diisocyanate, trimethylol isophorone diisocyanate, isocyanurate linked isophorone diisocyanate, triphenylmethane triisocyanate, tris (isocyanate phenyl) thiophosphate and the like.

Examples of synthetic method of the isocyanate compound include the prior art methods, for example, a reaction of amines with phosgene, a reaction of diazonium salts with isocyanic acids and the like.

Techniques of forming a condensation compound of the isocyanate compound and water in a coating layer are a technique in which water is added to a composition for forming a coating containing a thermoplastic resin and isocyanate compound; a technique in which a drying step during forming a coating layer is carried under an atmosphere such that moisture is absorbed into the layer, and the like. It is also possible to form a condensation compound of the isocyanate compound and moisture in a solvent that dissolves the resin, without addition of water as described above.

The toner-receiving layer of the recording medium for electrophotography used in the invention can be formed by dissolving the above polymers into an organic solvent, or dispersing with water as an emulsified dispersion, applying it on the support and drying the support. Also, the toner-receiving layer may be formed by melting the polymer, extruding it and laminating on the support.

Physical properties of the toner-receiving layer of the recording medium for electrophotography are those which satisfy one or more of the following items, more preferably plural items, and most preferably all the items:

(1) A Tg (a glass temperature) of the toner-receiving layer is from 30° C. to the toner Tg+20° C.;

(2) A T½ (a ½ method softening point) of the toner-receiving layer is from 60° C. to 150° C., and more preferably from 80° C. to 120° C.;

(3) A Tfb (a temperature of flow beginning) of the toner-receiving layer is 100° C. or less, preferably from 40° C. to 100° C., and more preferably the toner Tfb+10° C. or less;

(4) A temperature, in which a viscosity of the toner-receiving layer becomes $1\times10^5$ CPS, is from 40° C. or more, below a temperature that a viscosity of the toner becomes $1\times10^5$ CPS;

(5) A storage elastic modulus (G') in a fixing temperature of the toner-receiving layer is from $1\times10^2$ Pa to $1\times10^5$ Pa, and a loss elastic modulus (G") thereof is from $1\times10^2$ Pa to $1\times10^5$ Pa;

(6) A loss tangent (G"/G') which is a ratio of a loss elastic modulus (G") to a storage elastic modulus (G') in a fixing temperature of the toner-receiving layer is from 0.01 to 10;

(7) A storage elastic modulus (G') in a fixing temperature of the toner-receiving layer is from −50 to +2500 based on a storage elastic modulus (G") in a fixing temperature of the toner-receiving layer; and (8) An angle of inclusion on the melt toner-receiving layer is 50° or less, and especially 40° or less.

The toner-receiving layer is preferred which satisfies physical properties disclosed in Japanese Patent No. 2788358, Japanese Unexamined Patent Publication (KOKAI) Heisei No. 7-248637, Japanese Unexamined Patent Publication (KOKAI) Heisei No. 8-305067, Japanese Unexamined Patent Publication (KOKAI) Heisei No. 10-239889, and the like.

The physical properties listed in the above (1) can be measured by a differential scanning calorimeter apparatus (DSC). The physical properties listed in from (2) to (4) can be measured, for example,. using a Flow Tester CFT-500 manufactured by Shimadzu Seisakusho. The physical properties listed from (5) to (7) can be measured by a rotary rheometer (such as a dynamic analyzer RADII manufactured by Rheometric Co. Ltd.). The physical properties listed in (8) can be measured using a contact angle measuring equipment manufactured by KYOWA KAIMEN KAGAKU Co. Ltd. according to a technique disclosed in Japanese Unexamined Patent Publication (KOKAI) Heisei No. 8-334916.

The recording medium for electrophotography used in the invention preferably has a surface resistance of the toner-receiving layer surface of from $10^6$ Ω/cm$^2$ to $10^{12}$ Ω/cm$^2$, with special preference given to $10^9$ Ω/cm$^2$ or less. An adhesion of the toner tends to rapidly deteriorate at the surface resistance of $10^{12}$ Ω/cm$^2$ or more and only an off-tone image is obtained at the surface resistance of $10^6$ Ω/cm$^2$ or less. An anionic or cationic material, especially an anionic surfactant, a cationic surfactant or an ampholytic surfactant can be used in the recording medium for electrophotography in order to obtain a surface resistance of $10^{12}$ Ω/cm$^2$ or less.

The coloring matter-fixing agent capable of fixing the coloring matter is added to the toner-receiving layer together with a resin capable of fixing the coloring matter contained in the toner. The coloring matter-fixing agent is a material having a function that immobilizes the coloring matter migrated to the toner-receiving layer for forming an image. Fixing the coloring matter to vanish diffusibility of the coloring matter in the toner-receiving layer can effectively control discoloration and blurring that generated during the storage of images. Moreover, a problem of migrating the coloring matter to the other materials in contact therewith when piled and contaminating the image can be prevented.

The types of the coloring matter-fixing agent used in the toner-receiving layer are selected from the materials having a function of fixing the coloring matter that constitutes the toner. Therefore, it is necessary to select the coloring matter-fixing agent in combination with the coloring matter. Specifically, it is preferred to use a material described in the following explanation on the coloring matter.

Releasing agents, anti-oxidants, UV absorbents, anti-discoloring agents, fillers and pigments, as well as plasticizers and heat-fusing materials as sensitizing agents may be added to the toner-receiving layer. The sum of these additives is preferably in a range of from 0.1 to 30% by weight based on a binder for the toner-receiving layer.

The releasing agent to be added to the toner-receiving layer is a material having a function that improves releasability after a surface of the toner-receiving layer is in contact with the other materials. Examples of these releasing agents include silicone oil (including those referred to silicone resin); solid waxes such as polyethylene wax, amide wax, and Teflon powder; fluoride series and phosphate esters series surfactants. Among others, silicone oils are preferred. There are two types of silicone oils: a simple addition-type silicone oil that only requires an addition and a curing reaction-type silicone oil that requires a curing or a reaction.

As the simple addition-type silicone oils, it is preferred to use modified silicone oils (for example, polyester modified silicone resin, urethane modified silicone resin and acrylic modified silicone resin and the like) so as to improve a compatibility with the binder. A loading amount of the simple addition-type silicone oils varies depending on the types thereof; therefore, the amount thereof can not be determined in the same category. Generally, it is typically from 0.1 to 50% by weight, and preferably from 0.5 to 20% by weight based on the binder for the toner-receiving layer.

Examples of the cure reaction-type silicone oil include a reaction-cure type (such as a reaction-cured product of an amino modified silicone oil with epoxy modified silicone oil and the like), a photo-cure type and a catalyst-cure type silicone oil and the like. A loading amount of these cure type silicone oils is preferably from 0.5 to 30% by weight of the binder for the toner-receiving layer.

Further, a releasing agent layer can be prepared by dissolving or dispersing the above releasing agent in a suitable solvent, applying the solution or the dispersion on a part of the surface of the toner-receiving layer, and then drying and the like.

The anti-oxidant to be added to the toner-receiving layer include anti-oxidants disclosed in Japanese Unexamined Patent Publication (KOKAI) Showa No. 59-182785, Japanese Unexamined Patent Publication (KOKAI) Showa No. 60-130735, and Japanese Unexamined Patent Publication (KOKAI) Heisei No. 1-127387, as well as the well known compounds as which improve an image durability in a photography or other image recording medium.

The UV absorbent and the anti-discoloring agent to be added to the toner-receiving layer include compounds disclosed respectively in Japanese Unexamined Patent Publication (KOKAI) Showa No. 59-158287, Japanese Unexamined Patent Publication (KOKAI) Showa No. 63-74686, Japanese Unexamined Patent Publication (KOKAI) Showa No. 63-145089, Japanese Unexamined Patent Publication (KOKAI) Showa No. 59-196292, Japanese Unexamined Patent Publication (KOKAI) Showa No. 62-229594, Japanese Unexamined Patent Publication (KOKAI) Showa No. 63-122596, Japanese Unexamined Patent Publication (KOKAI) Showa No. 61-283595, and Japanese Unexamined Patent Publication (KOKAI) Heisei No. 1-204788, as well as the well known compounds as which improve an image durability in photography or other image recording medium.

The filler to be added to the toner-receiving layer include inorganic micro particles and organic micro particles. Examples of these inorganic micro particles include silica gel, calcium carbonate, titanium oxide, acidic china clay, alumina and the like, and examples of these organic micro particles include resin particles such as fluoroplastic particles, guanamine resin particles, acrylic resin particles, silicone resin particles and the like. Depending on its specific gravities, these inorganic·organic resin particles are preferably added in an amount of from 0 to 30% by weight.

The pigment to be added to the toner-receiving layer include titanium white, calcium carbonate, zinc oxide, barium sulfate, silica, talc, clay, kaolin, active china clay, acidic china clay and the like.

The plasticizers to be added to the toner-receiving layer include phthalic acid esters, trimellitic acid esters, avidin acid esters, other saturated or unsaturated carboxylic acid esters, citric acid esters, epoxy soybean oil, epoxy linseed oil, epoxy stearic acid esters, orthophosphoric acid esters, phosphorous acid esters, glycolic acid esters and the like.

The heat-fusing materials to be added to the toner-receiving layer include alcohols such as terpineol, menthol, 1,4-cyclohexanediol, phenol and the like; amides such as acetamide, benzamide and the like; esters such as coumarin, cinnamic acid benzyl and the like; ethers such as diphenyl ether, crown ether and the like; ketones such as camphor, p-methoxy acetophenone and the like; aldehydes such as vanillin, dimethoxy benzaldehyde and the like; hydrocarbons such as norbornene, stilbene and the like; higher fatty acids such as margarine and the like; higher alcohols such as eicosanol and the like; higher fatty acid esters such as palmitin acid cetyl and the like; higher fatty acid amides such as stearic amide and the like; monomolecular compounds represented by higher amines such as behenyl amine and the like; waxes such as carnauba wax, bee wax, paraffin wax, ester wax, montan wax, amide wax and the like; rosin derivatives such as ester gum, rosin maleic acid resin, rosin phenol resin and the like; phenolic resin, ketone resin, epoxy resin, diallyl phthalate resin, terpene resin, aliphatic carbohydrate resin, cyclopentadiene resin, polyolefin resin, macromolecular compounds represented by polyolefin oxides such as polyethylene glycol and polypropylene glycol and the like.

The recording medium for electrophotography used in the invention may have, in addition to the toner-receiving layer, a surface protective layer, an intermediate layer, an undercoating layer, a cushion layer, a charge controlling (antistatic) layer, a reflective layer, a color conditioning layer, a shelf stability modifying layer, an anti-adhesive layer, an anti-curl layer, a smoothing layer and the like. Each layer may be a laminate of two or more.

Each layer on the support is preferably transparent, when the recording medium for electrophotography is a transmission-type recording medium in which the toner-receiving layer and the like are placed on the transparent support. In a case of the reflection-type recording medium in which the toner-receiving layer is placed on the reflection support, each layer on the support need not to be transparent and it is preferred to be white rather than being transparent. The whiteness is measured according to a method defined in JIS P 8123, and with preference given to a whiteness of 85% or more. A spectral reflectance in a wavelength range of 440 nm–640 nm of 85% or more and a difference between the maximum and the minimum spectral reflectance in the same wavelength of within 5% are preferred. Moreover, a spectral reflectance in a wavelength range of from 440 nm to 640 nm of 85% or more and a difference between the maximum and the minimum spectral reflectance in the same wavelength of within 5% are preferred.

The recording medium for electrophotography of the invention may have a layer containing microvoids between the support and the toner-receiving layer.

The term "void" as used herein means an air gap in which a solid or a liquid material constituting a layer is absent, and a gas may be present in the air gap. A shape of a microvoid is ideally a convex lens type, that is, a shape when two pieces of concave lenses are piled one over the other. It is preferred that the microvoid is oriented in a diameter direction of the convex lens, that is, the diameter direction of the microvoid is horizontally-oriented to a surface of the recording medium for electrophotography. The microvoid is typically is a closed-air bubble, and there are substantially no pores in which a gas and a liquid can pass through.

A forming method of a microvoid is not especially limited. Typically, the microvoid can be formed in the layer by adding a void-initiating material to a base for a layer, extruding the base, and orienting the extrudate. At this time, a layer having microvoids and other layers may be simultaneously extruded and oriented. Although either uniaxial or biaxial orientation may be used, it is preferred to employ biaxial orientation. Microvoids are formed around the void-initiating material by simultaneously extruding and orienting. A forming method as disclosed in U.S. Pat. No. 4,377,616 on composit films can be also used as another method for forming microvoids.

The base containing microvoids are mainly polymers. The void-initiating material can be selected from various materials, with preference given to a polymeric material. A loading amount of the void-initiating material is preferably from about 5 to 50% by weight based on the weight of the base.

When the polymeric material is used as the void-initiating material, a layer in which spherical particles are dispersed can be obtained by melt-mixing the polymeric material with a polymer base for the layer and then cooling the mixture. Specifically, Nylon dispersed in polypropylene, polybutylene terephtalate dispersed in polypropylene, or polypropylene dispersed in polybutylene terephthalate are illustrated.

It is preferred that a particle size and a particle shape of the void-initiating material to be mixed into the base polymer is determined depending on the microvoids to be formed. A diameter of the particles of the void-initiating material is preferably from 0.1 to 10 $\mu$m, and a shape thereof is preferably a hollow or a solid sphere. The void-initiating material of the spherical particles can be obtained by cross-linking a compound having a vinyl group.

The thickness of the layer containing the microvoids is preferably from 10 to 300 $\mu$m, and more preferably from 150 to 250 $\mu$m. The thickness of the layer containing the microvoids is preferably from 15 to 95%, and more preferably from 30 to 85% of a total thickness of the recording medium for electrophotography. The density of the layer containing the microvoids is preferably from 0.2 to 1.0 g/cm$^3$, and more preferably from 0.3 to 0.7 g/cm$^3$.

When the thickness of the layer containing the microvoids is 30% or less, or the density thereof is over 0.7 g/cm$^3$, compression properties and thermal insulating properties of the layer containing the microvoids decrease. When the thickness of the layer containing the microvoids is over 85%, or the density thereof is 0.3 g/cm$^3$ or less, the tensile strength of the layer containing the microvoids decreases to reduce its processability, and further the layer readily suffers from physical damages.

The layer containing the microvoids can be laminated on the above support by means of a lamination and the like. Another polymeric layer free from the microvoids may be placed between the support and the layer containing the microvoids. It is preferred that another polymeric layer comprised of polyolefin and the like is placed on the surface of the support opposite to the toner-receiving layer.

Next, a toner constituting the recording material for electrophotography of the invention is described.

In the toner constituting the recording material for electrophotography of the invention, the types thereof is not especially limited as long as it contains a coloring matter capable of migrating to a resin by heating. The term "capable of migrating by heating" as used herein means to be able to migrate to the toner-receiving layer of the recording material for electrophotography by a recording means according to the electrophotography.

It is necessary that the coloring matter to be contained in the toner possess both basic properties (hue, fastness to light, fastness to heat, water-resistance, opacifying properties and the like) to be possessed as the coloring matter, and physical properties (moderate melting point, hydrophobic nature, diffusion) required for the recording toner according to the electrophotography. The materials of the coloring matter is not especially limited as long as it possesses the above properties. Therefore, so-called a subliming dye can be used. The coloring matter having the known basic skeletal structures such as azo-, azomethine-, anthraquinone-, benzoquinone-, methine-, polymethine-, diphenyl methane-, triphenyl methane-, fluoran-, azine-, acridine-, quinone-, indigo-, quinacridone-, quinophthalone-, naphthalimide-, phthalocyanine-series and the like can be preferably used. Specific examples of the preferred coloring matter are listed according to their hues.

1. Coloring matter: Yellow

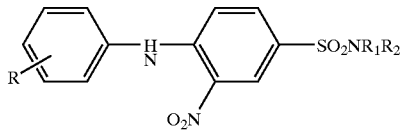

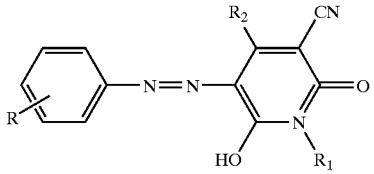

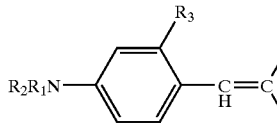

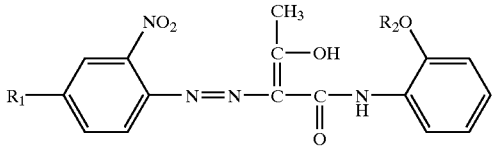

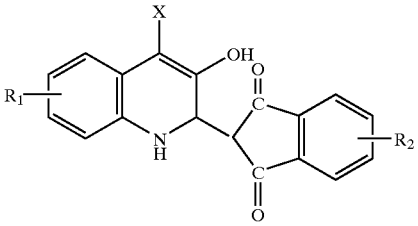

-continued
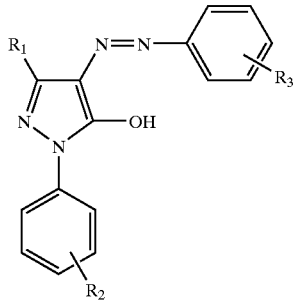
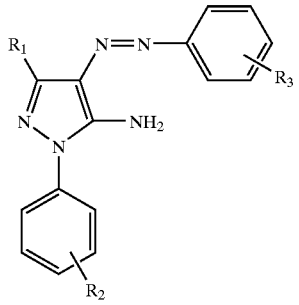
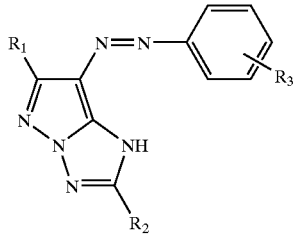
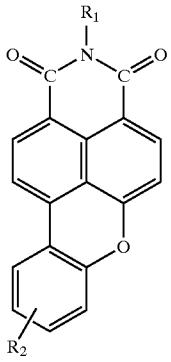
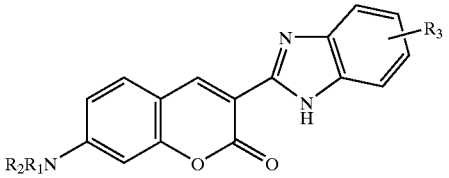
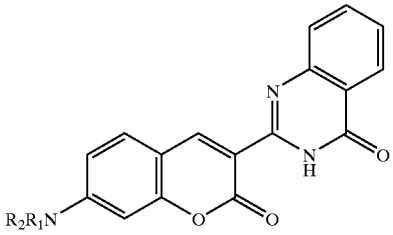
-continued
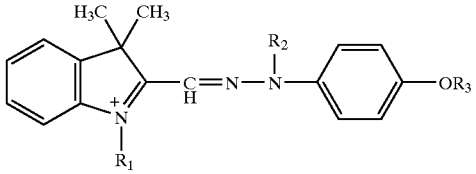
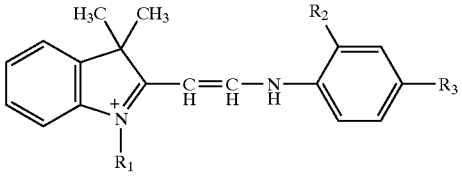
2. Coloring matter: Red, Magenta
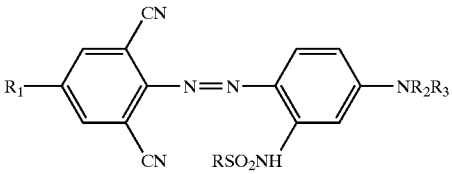
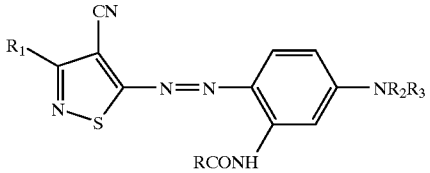
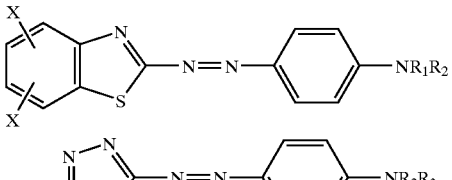
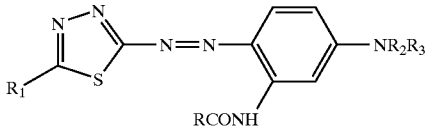
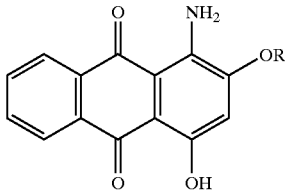
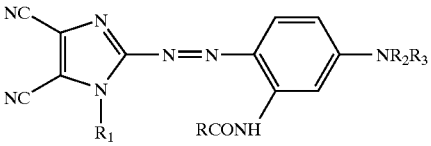
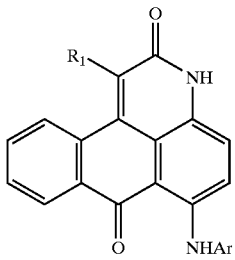

-continued
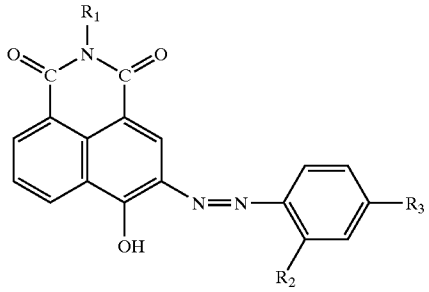
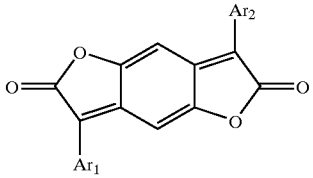
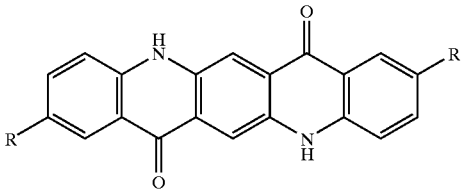
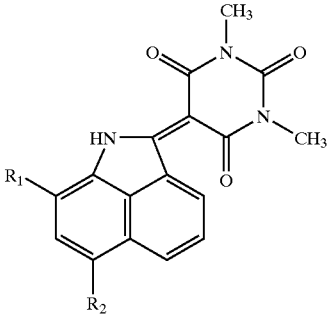
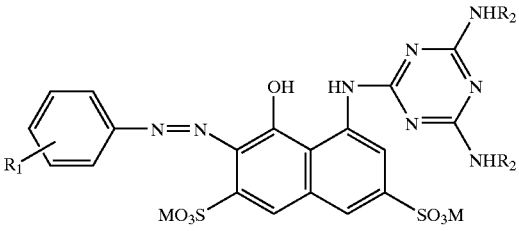
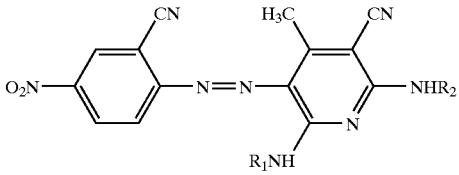
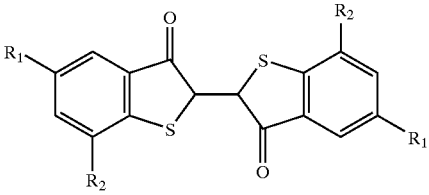
-continued
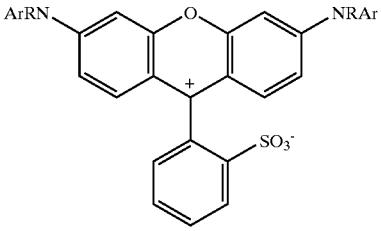
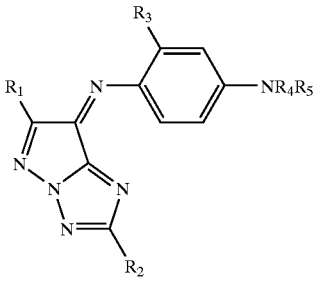
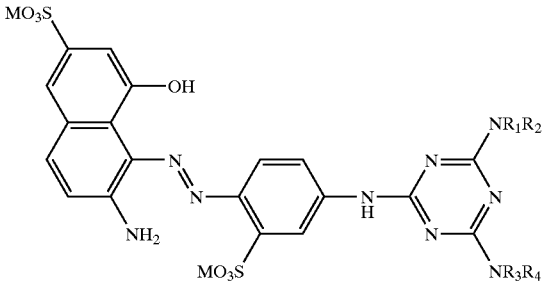
3. Coloring matter: Blue, Cyan
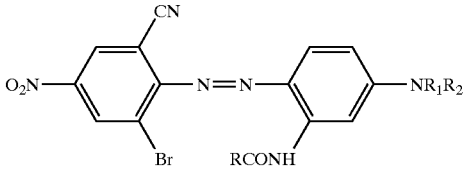
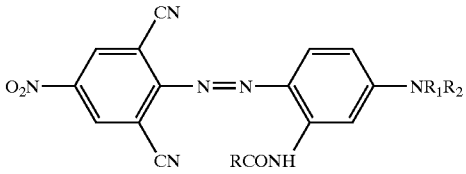
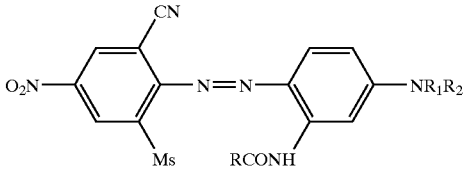
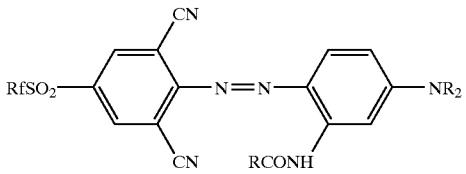

-continued
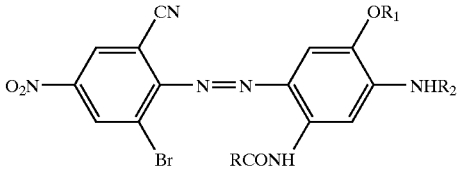
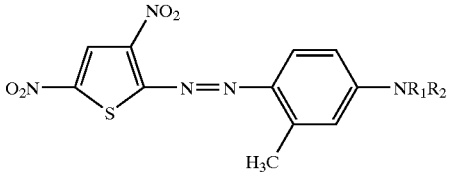
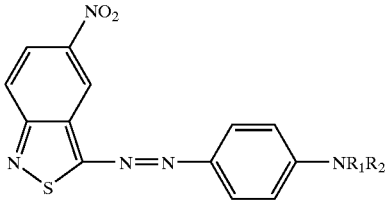
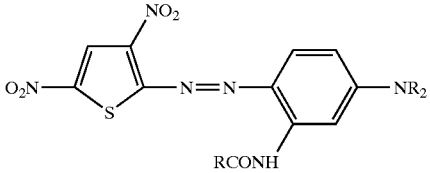
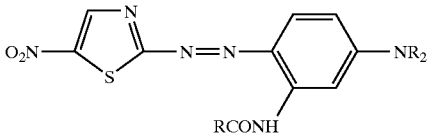
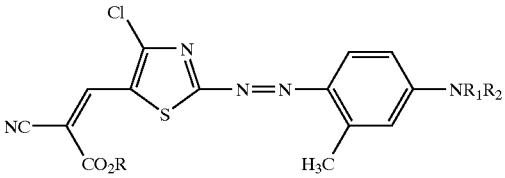
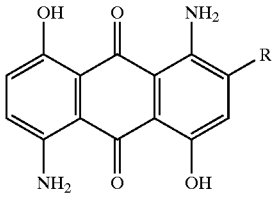
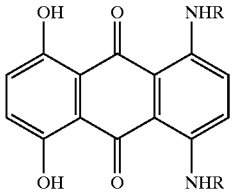
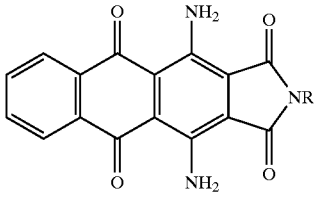
-continued
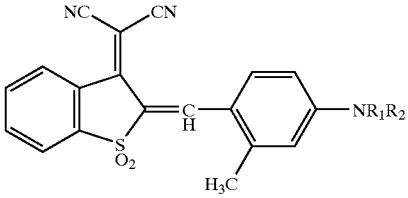
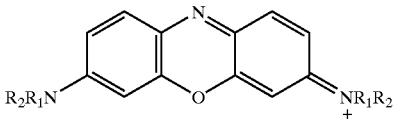
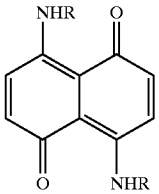
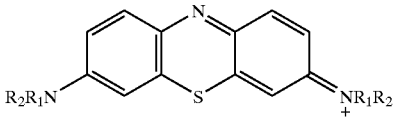
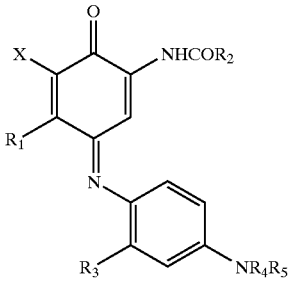
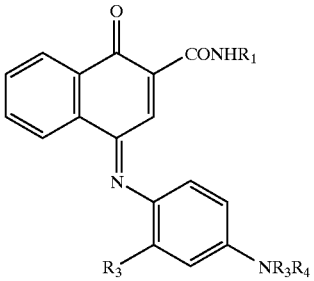
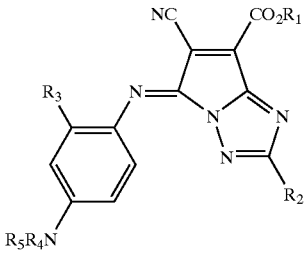

-continued

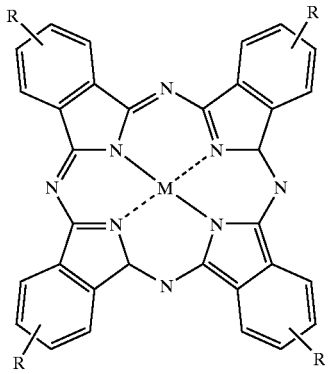

4. Coloring matter: Black

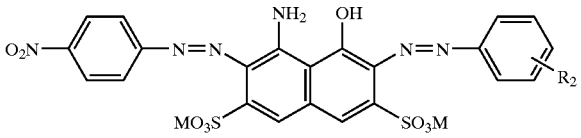

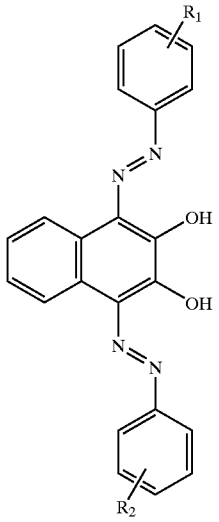

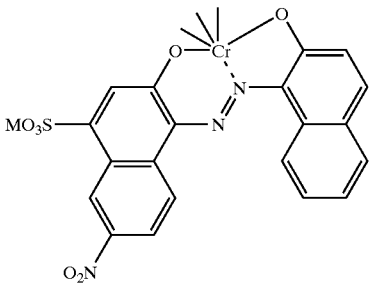

-continued

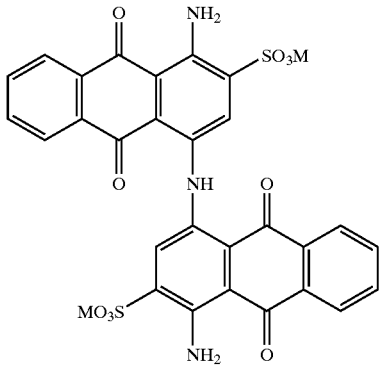

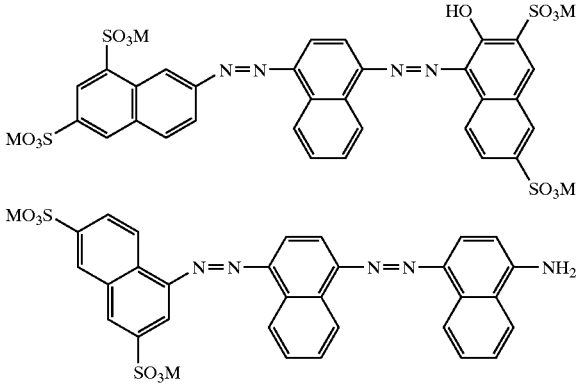

The coloring matters to be contained in the toner should be those that can be fixed by the coloring matter-fixing agent contained in the toner-receiving layer after image recording. From these viewpoints, it is necessary to select the coloring matter to be used in the invention in combination with the coloring matter-fixing agent. A combination of the coloring matter and the coloring matter-fixing agent is not especially limited as long as the fixation is available. Among others, the coloring matter in which special reactivity is added to the skeletal structure itself and the coloring matter in which a functional group capable of fixing is introduced in its molecule are preferable. Preferable combinations of the coloring matter and the coloring matter-fixing agent are listed below.

For example, a metal ion or a compound capable of providing the metal ion can be selected as the coloring matter-fixing agent; and a compound that forms a chelate with the metal ion can be selected as the coloring matter (method 1). This combination is disclosed in Japanese Unexamined Patent Publication (KOKAI) Heisei No. 3-197088, Japanese Unexamined Patent Publication (KOKAI) Heisei No. 4-62092, Japanese Unexamined Patent Publication (KOKAI) Heisei No. 4-65293, Japanese Unexamined Patent Publication (KOKAI) Heisei No. 4-89292, Japanese Unexamined Patent Publication (KOKAI) Heisei No. 4-119892, Japanese Unexamined Patent Publication (KOKAI) Heisei No. 4-344290, Japanese Unexamined Patent Publication (KOKAI) Heisei No. 11-115325 and the like.

An acidic material or acidic polymer can be selected as the coloring matter-fixing agent; a basic compound or a compound having a basic group can be selected as the coloring matter (method 2). This combination is disclosed in Japanese Unexamined Patent Publication (KOKAI) Showa No. 58-220788, Japanese Unexamined Patent Publication (KOKAI) Showa No. 61-14994, Japanese Unexamined Patent Publication (KOKAI) Showa No. 63-173692, Japanese Unexamined Patent Publication (KOKAI) Showa No. 64-3176, Japanese Unexamined Patent Publication (KOKAI) Heisei No. 1-105789, Japanese Unexamined Patent Publication (KOKAI) Heisei No. 5-238174 and the like.

A basic material or a polymeric mordant having a basic group can be selected as the coloring matter-fixing agent; and a compound having an acidic dissociating group can be selected as the coloring matter (method 3). This combination is disclosed in Japanese Unexamined Patent Publication (KOKAI) Showa No. 61-64492, Japanese Unexamined Patent Publication (KOKAI) Heisei No. 1-188391, Japanese Unexamined Patent Publication (KOKAI) Heisei No. 3-83685, Japanese Unexamined Patent Publication (KOKAI) Heisei No. 3-83687, Japanese Unexamined Patent Publication (KOKAI) Heisei No. 3-83688, Japanese Unexamined Patent Publication (KOKAI) Heisei No. 3-83689, Japanese Unexamined Patent Publication (KOKAI) Heisei No. 3-90387, Japanese Unexamined Patent Publication (KOKAI) Heisei No. 3-92385, Japanese Unexamined Patent Publication (KOKAI) Heisei No. 3-114890 and the like.

A high-molecular weight nucleophilic compound (active hydrogen compound) can be selected as the coloring matter-fixing agent; and a compound having an electrophilic center can be selected as the coloring matter (method 4). This combination is disclosed in Japanese Unexamined Patent Publication (KOKAI) Heisei No. 5-221151 and the like.

Further, fixation of the coloring matter can be carried according to Diels-Alder reaction. That is, a diene compound can be selected as the coloring matter-fixing agent and a dienophile compound can be selected as the coloring matter; or a dienophile compound can be selected as the coloring matter-fixing agent and a diene compound can be selected as the coloring matter (method 5). This combination is disclosed in Japanese Unexamined Patent Publication (KOKAI) Heisei No. 6-64343, Japanese Unexamined Patent Publication (KOKAI) Heisei No. 7-132685, Japanese Unexamined Patent Publication (KOKAI) Heisei No. 7-144478 and the like.

A compound, in which highly reactive carboxylic acid ester, sulfonic acid ester and a compound that an electrophilic group such as a cyclic acid anhydride and the like is coupled with in its molecule, can be selected as the coloring matter; and an amine compound of a high molecular weight which reacts with the coloring matter can be selected as the coloring matter-fixing agent (method 6). This combination is disclosed in Japanese Unexamined Patent Publication (KOKAI) Heisei No. 6-32074.

A polymeric compound having active hydrogen such as polyol and polyamine can be selected as the coloring matter-fixing agent; and a compound in which an electrophilic group such as aziridine group and epoxy group is introduced can be selected as the coloring matter (method 7). This combination is disclosed in Japanese Unexamined Patent Publication (KOKAI) Heisei No. 6-1087 and the like.

A thermo-polymerization initiator can be selected as the coloring matter-fixing agent; and a compound having a polymerizable group in its molecule can be selected as the coloring matter (method 8). This combination is disclosed in Japanese Unexamined Patent Publication (KOKAI) Heisei No. 6-87275 and the like.

A deprotonated cationic compound can be selected as the coloring matter; and a compound that can re-protonate said deprotonated compound can be selected as the coloring matter-fixing agent (method 9). When both reactants are reacted, a cationic coloring matter having a N-H group as a part of a conjugated system is formed. This combination is disclosed in Japanese Unexamined Patent Publication (KOKAI) Heisei No. 11-70750, U.S. Pat. No. 4,880,769, U.S. Pat. No. 4,137,042, U.S. Pat. No. 5,559,076 and the like.

A toner structure is not especially limited as long as it has a function capable of migrating to the toner-receiving layer of the recording medium for electrophotography by heating. The toner structure used in a typical electrophotography can be applied.

A preferable structure includes a capsule type toner comprised of a core and a shell. It is preferable that the core comprises transparent rein particles, and the average particle diameter of from around 5 to 8 $\mu$m is preferable so as to form a highly qualified image. Moreover, it is preferable to use a high thermal melting resin having a softening point of from 90 to 120° C. in order to improve smoothness of the image. A co-polymerized rein having an (meth) acrylic copolymerization component is preferably used as a resin having a low softening point. A transparent resin, which is preferred to use as the core, includes styrene resin, (meth) acrylic resin, styrene-(meth) acrylic resin and the like. Monomers used to obtain transparent resin particles include: (meth) acrylic acid ester-monomers, such as (meth) acrylic acid methyl, (meth) acrylic acid ethyl, (meth) acrylic acid propyl, (meth) acrylic acid butyl, (meth) acrylic acid-2-ethylhexyl, (meth) acrylic acid dimethylaminoethyl and the like; and styrene-monomers, such as styrene, $\alpha$-methylstyrene, chlorostyrene, p-methylstyrene and the like. The transparent rein particles can be readily prepared by using a suspension polymerization method. The shell of the capsule type toner has a composition in which the coloring matter is dispersed in the thermoplastic binder resin. The thermoplastic resin constituting the shell includes styrene-acrylic resin, styrene-butadiene resin, polyester resin and the like.

The capsule type toner can be prepared by applying the well-known encapsulatization method. Specifically, the capsule type toner can be prepared by dissolving the binder resin constituting the shell and the coloring matter in a solvent to make a solution, dispersing the transparent resin particles obtained by the suspension polymerization method in the solution, and then drying by spray drying.

If necessary, additives may be added to the toner in addition to the above materials. For example, internal additives such as a water-white charge controlling agent, wax and the like, as well as external additives such as inorganic oxide micro particles and the like may be added.

The toner prepared by a polymerization method can be preferably used in the invention. The type of the polymerization method is not especially limited, and with preference given to a hybrid polymerization method and the like. The hybrid polymerization method is a method wherein problems caused in a polymerization of an acrylic polymerizable monomer alone is improved by combining the acrylic polymerizable monomer and polymeric compounds such as polyester, epoxy and the like.

The preparations of the toner by the polymerization method are disclosed in Japanese Unexamined Patent Publication (KOKAI) Heisei No. 7-175268, Japanese Unexamined Patent Publication (KOKAI) Heisei No. 8-179552, Japanese Unexamined Patent Publication (KOKAI) Heisei No. 8-234493, Japanese Unexamined Patent Publication (KOKAI) Heisei No. 8-234494 and the like. In addition, a polymerization method based on an emulsified polyester by coloring as disclosed in Japanese Unexamined Patent Publication (KOKAI) Heisei No. 7-56390; a spherical toner preparation by a dispersion polymerization as disclosed in Japanese Unexamined Patent Publication (KOKAI) Heisei No. 7-325490; a preparation of a polymerized color toner by resin-modifying a colorant as disclosed in Japanese Unexamined Patent Publication (KOKAI) Heisei No. 7-84410; and a preparation using an inline homogenizer as disclosed in Japanese Unexamined Patent Publication (KOKAI) Heisei No. 7-261453 and the like.

The toner may be mixed with a magnetic carrier to constitute two-component color developing agent, thereby improving flowability, friction-static electrification, developing properties, image reproducibility and the like. The magnetic carrier such as magnetic particles, for example, iron, ferrite, magnetite and the like; or magnetic particles obtained by a coating-treatment these magnetic particles with styrene-acrylic resin, silicon resin, fluorine resin and the like can be used.

The present invention provides an image forming method using the toner and the recording medium for electrophotography constituting the above recording material for electrophotography. The image forming method of the invention is characterized in that an image is formed by a toner constituting the recording material for electrophotography on the recording medium for electrophotography constituting the recording material for electrophotography, and fixing the toner transferred into the toner-receiving layer for image forming by means of the coloring matter-fixing agent.

The image forming method of the invention does not especially limit a method for forming images. The image is formed on the toner-receiving layer for electrophotography using any conventional recording means for electrophotography. When the recording medium has the toner-receiving layers on the both sides, images may be formed on the both sides.

After image forming, the coloring matter, which is migrated to the toner-receiving layer, is fixed by means of the coloring matter-fixing agent contained in the toner-receiving layer. A fixation is carried under the condition that a fixing reaction progresses. Although the fixing reaction usually progresses at the room temperature; it is preferred to enhance the fixation by heating. The heating temperature is from 80 to 180° C., preferably from 100 to 170° C., and more preferably from 120 to 160° C. The heating time usually varies from 1 to 200 seconds, and preferably from around 2 to 100 seconds per a sheet of A4 size paper.

A heating method is not especially limited; the heating can be carried using a heat roller and the like. In the recording according to the electrophotography, the thermoplastic polymer is fused to the recording medium to fix an image after migrating the toner to the toner-receiving layer. Thus, it is preferred that the fixing reaction simultaneously progresses during the fixation step.

EXAMPLES

The present invention will now be described in details with reference to the following examples. Materials, reagents, proportions, operations or the like shown in the following examples can be suitably changed without departing from the spirit of the invention. Thus, the following examples should not be regarded as limiting the scope of the invention.

Examples 1 to 8

1) Preparation of Toners

Transparent resin particles (core) comprised of a styrene-methyl methacrylate-butyl acrylate copolymer (mass composition ratio; 40:30:30, a softening point 110° C., an average particle diameter 7.5 μm) were prepared by a suspension polymerization in an aqueous medium using polyvinyl alcohol as a dispersant.

A shell forming solution was prepared by dissolving and dispersing 30 parts by weight of a polyester rein obtained from an esterified bisphenol A-terephthalic acid-fumaric acid and 10 parts by weight of the coloring matter specified below in chloroform solvent.

After 60 parts by weight of said transparent resin particles were added to the resulting the shell forming solution, a capsule type toner was made by spray drying. This process was repeated with regard to each of yellow, magenta and cyan coloring matters to make three kinds of toners.

2) Preparation of Recording Medium for Electrophotography

A thickness of 10 μm of a toner-receiving layer was prepared by coating a coating liquid for forming a toner-receiving layer having following compositions on a laminate paper support (thickness 200 μm) coated on the both sides with polyethylene using a wire bar, and drying the resulting support.

Composition of a Coating Liquid for Forming a Toner-receiving Layer:

| | |
|---|---|
| Coloring matter-fixing agent specified below: | 5 parts by weight |
| Polyester rein (TUFTONE U-5, Kao Corporation) | 30 parts by weight |
| Methyl ethyl ketone | 65 parts by weight |

3) Preparation of Image

An image was formed by forming an image with the toner made under 1) on the recording medium for electrophotography made under 2) using a printer (printer DC-1250, Fuji Xerox Co. Ltd.) to fix the coloring matter.

All the images formed in Examples 1 to 8 were excellent in color reproducibility, high in recording density, and good in smoothness of the recording surface. In addition, any discoloration and bleeding were not observed even after a storage at 60° C. for 8 weeks.

Example 1

Method 1

Yellow:

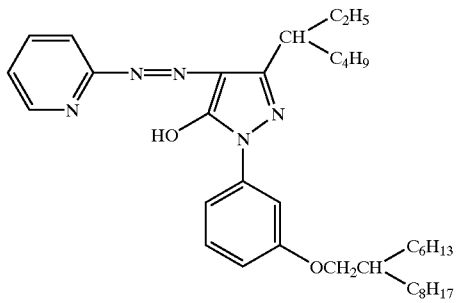

-continued
Magneta:
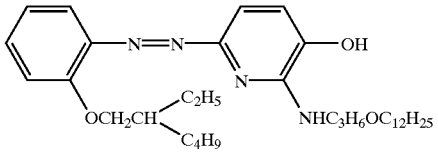
Cyan:
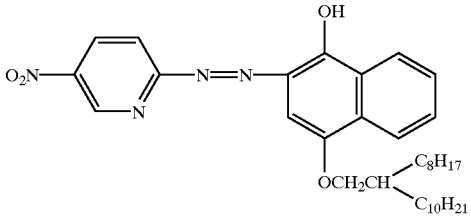
Coloring Matter-fixing Agent
(The Component for the Toner-receiving Layer):
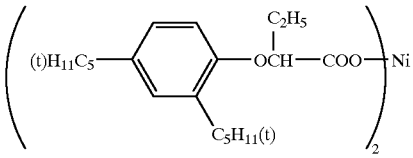
0.5–3.0 g/m$^2$
Example 2
Method 2
Yellow:
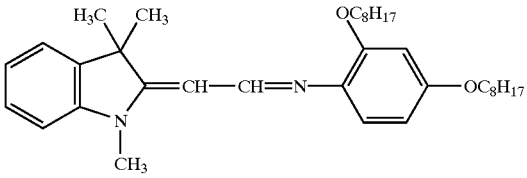
Magenta:
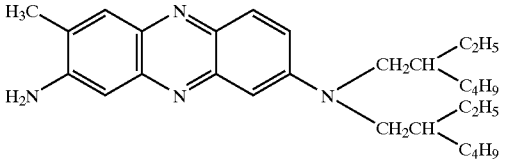
Cyan:
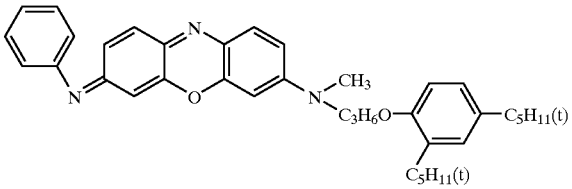
Coloring Matter-fixing Agent
(The Component for the Toner-receiving Layer):
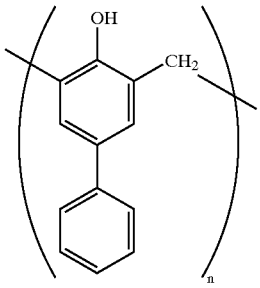
p-phenyl phenol novolak rein
1.0–3.0 g/m$^2$
Example 3
Method 3
Yellow:
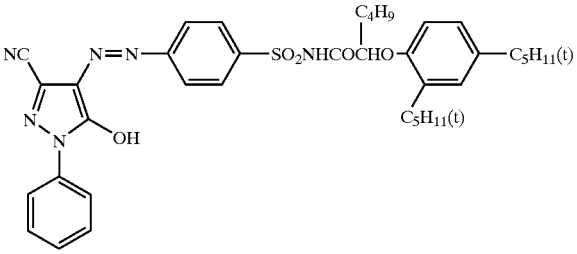
Magenta:
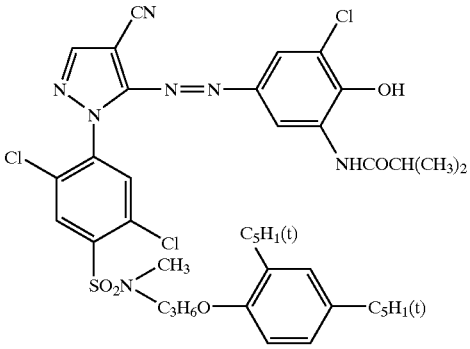

-continued
Cyan:
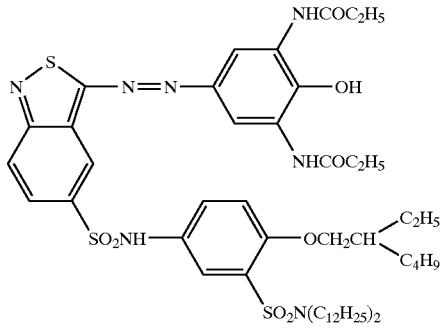
Coloring Matter-fixing Agent
(The Component for the Toner-receiving Layer):
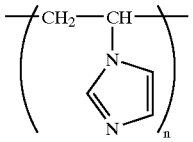
polyvinyl imidazole
1.0–3.0 g/m$^2$
Example 4
Method 4
Yellow:
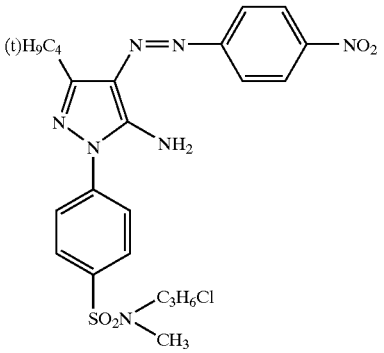
Cyan:
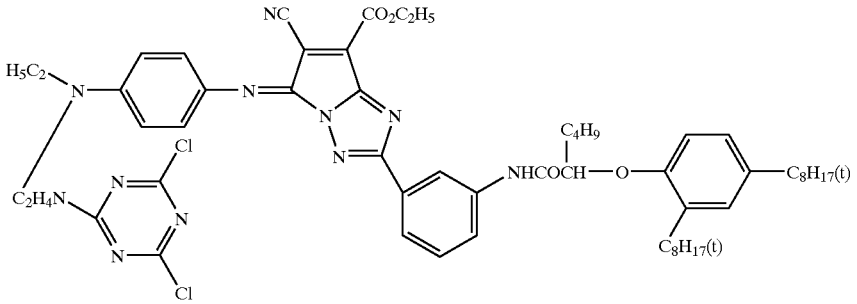
Coloring Matter-fixing Agent
(The Component for the Toner-receiving Layer):
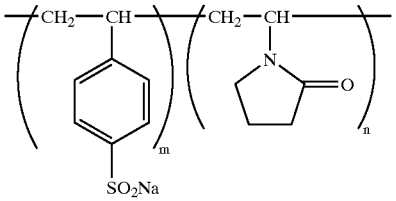
m:n = 1:1
A copolymer os styrene sodium
sufinate and N-vinyl pyrrolidone
1.5–3.0 g/m$^2$
Example 5
Method 5
Yellow:
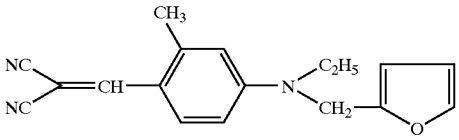
Magenta:
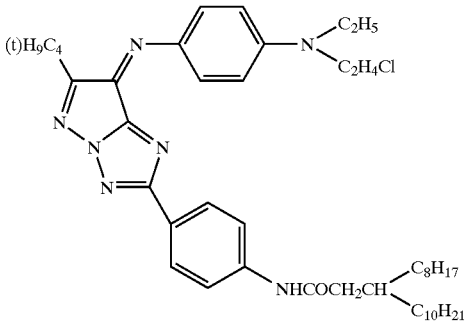

-continued
Magenta:
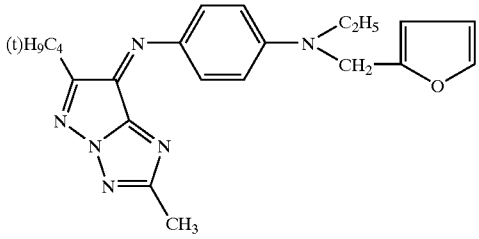
Cyan:
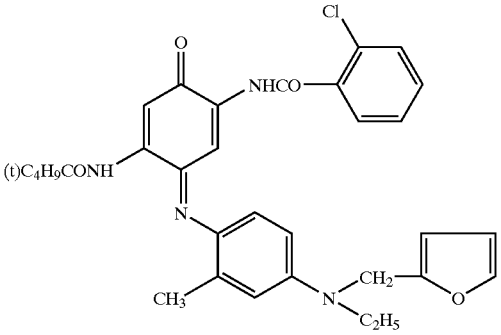
Coloring Matter-fixing Agent
(The Component for the Toner-receiving Layer):
N-octadecyl maleimide 1.0–2.5g/m$^2$
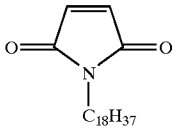
N-octadecyl maleimide
1.0–2.5 g/m$^2$
Example 6
Method 6
Yellow:
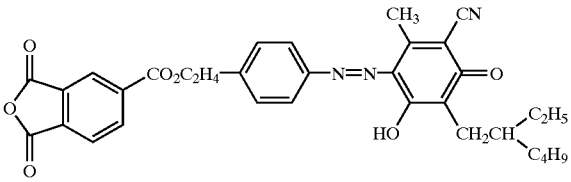
-continued
Magenta:
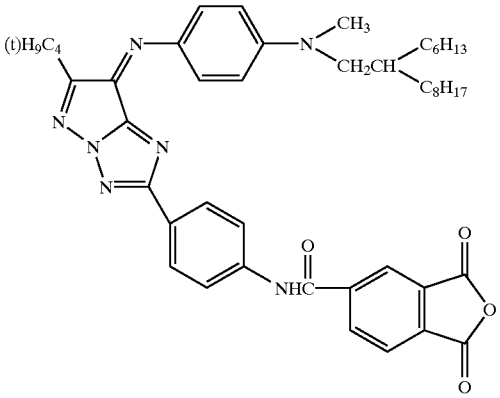
Cyan:
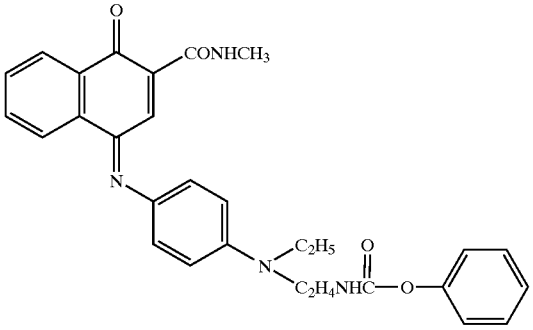
Coloring Matter-fixing Agent
(The Component for the Toner-receiving Layer):
Polyallylamine 0.5–2.5g/m$^2$
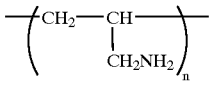
Polyallylamine
0.5–2.5 g/m$^2$
Example 7
Method 7
Yellow:
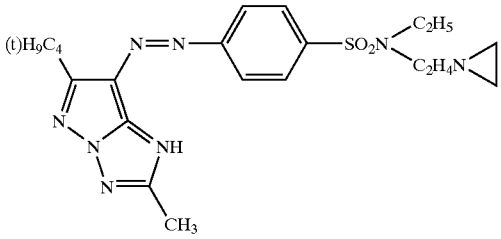

-continued

Magenta:

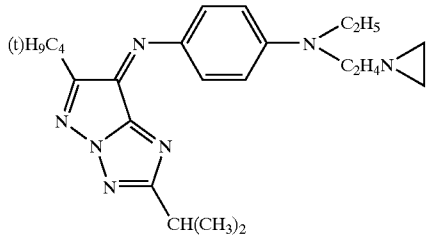

Cyan:

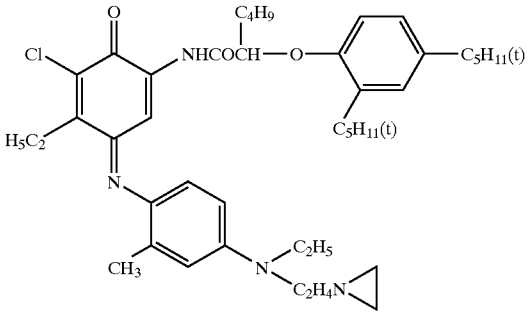

Coloring Matter-fixing Agent (The Component for the Toner-receiving Layer):

m:n=8:2 2.0–3.0 g/m$^2$

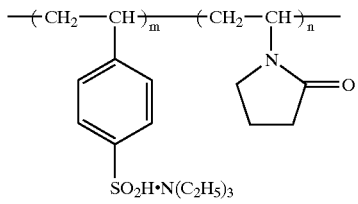

m:n = 8:2
2.0–3.0 g/m$^2$

Example 8

Method 10

Yellow:

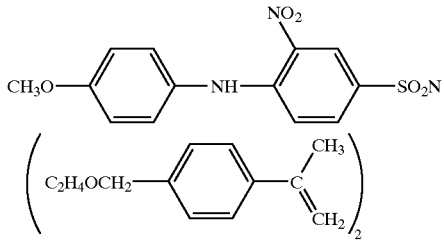

Magenta:

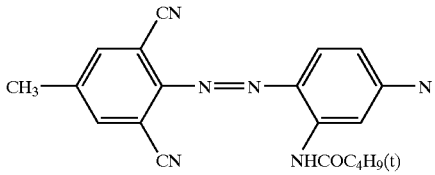

-continued

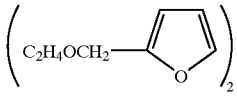

Cyan:

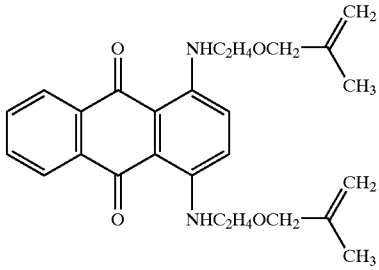

Coloring Matter-fixing Agent (The Component for the Toner-receiving Layer):

Amber-List-15 (a polystyrene sulfonic acid-strong acid ion exchange resin) 2.5–3.5g/m$^2$ Examples 9 to 16

Images were formed by making a toner and a recording medium for electrophotography according to the above examples, except that 10 parts by weight of a coloring matter-fixing agent was further added to the shell forming solution of the toner. Images of Examples 9 to 16 were formed by employing the combinations of the coloring matter and the coloring matter-fixing agent of Examples 1 to 8 respectively.

All the images formed in Examples 9 to 16 were excellent in color reproducibility, high in color density, and good in the smoothness of the recording surface. Even after a storage at 60° C. for 8 weeks, any discoloration and bleeding were not observed.

Examples 17 to 24

A toner was prepared using the polymerization method disclosed in Example 1 of Japanese Unexamined Patent Publication (KOKAI) Heisei No. 8-179552 instead of the toner preparation methods used in Examples 1 to 8. Other processes were the same as those of Examples 1 to 8; and the toner was prepared and the images were formed. Images of Examples 17 to 24 were formed by employing the combinations of the coloring matter and the coloring matter-fixing agent of Examples 1 to 8 respectively.

All the images formed in Examples 17 to 24 were excellent in color reproducibility, high in color density, and good in the smoothness of the recording surface. Even after a storage at 60° C. for 8 weeks, any discoloration and bleeding were not observed.

By forming images according to the electrophotography of the invention, images having excellent color reproducibility, high recording density, and good smoothness of the recording surface can be obtained. Moreover, a degradation due to discoloration and bleeding is rarely occurred on the image formed according to the invention during the storage. Therefore, the recording material for electrophotography and the image recording method of the invention can be widely utilized in image forming according to the electrophotography.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. A recording material for electrophotography comprising a toner containing a coloring matter, and a recording medium for electrophotography wherein a toner-receiving layer which receives the toner containing the coloring matter and contains resin capable of fixing the coloring matter contained in said toner is placed on a support, characterized in that said material contains a coloring matter-fixing agent capable of fixing the coloring matter by a fixing reaction in the toner and/or the toner-receiving layer.

2. The recording material for electrophotography according to claim 1, wherein said coloring matter-fixing agent has a function of fixing the coloring matter by heating.

3. The recording material for electrophotography according to claim 1, wherein said coloring matter-fixing agent can react with the coloring matter by the Diels-Alder reaction.

4. The recording material for electrophotography according to claim 1, wherein said coloring matter-fixing agent is a metal ion or a compound capable of providing the metal ion, and said coloring matter is a compound which forms a chelate with the metal ion.

5. The recording material for electrophotography according to claim 1, wherein said coloring matter-fixing agent is an acidic material or an acidic polymer, and said coloring matter is a basic compound or a compound having a basic group.

6. The recording material for electrophotography according to claim 1, wherein said coloring matter-fixing agent is a basic material or a polymeric mordant having a basic group, and said coloring matter is a compound having an acidic dissociating group.

7. The recording material for electrophotography according to claim 1, wherein said coloring matter-fixing agent is a high-molecular weight nucleophilic compound, and said coloring matter is a compound having an electrophilic center.

8. The recording material for electrophotography according to claim 1, wherein said coloring matter is a compound in which an electrophilic group is coupled with in its molecule, and said coloring matter-fixing agent is a high-molecular weight amine compound which reacts with the compound.

9. The recording material for electrophotography according to claim 1, wherein said coloring matter-fixing agent is a polymeric compound having an active hydrogen, and said coloring matter is a compound in which an electrophilic aziridine group and epoxy group is introduced.

10. The recording material for electrophotography according to claim 1, wherein said coloring matter-fixing agent is a thermo-polymerization initiator, and said coloring matter is a compound having a polymerizable group in its molecule.

11. The recording material for electrophotography according to claim 1, wherein said coloring matter is a deprotonated cationic compound, and said coloring matter-fixing agent is a compound capable of re-protonating said deprotonated compound.

12. The recording material for electrophotography according to claim 1, wherein said resin is a thermoplastic resin having a temperature of flow beginning (Tfb) of 100° C. or less.

13. The recording material for electrophotography according to claim 1, wherein said recording medium for electrophotography contains an anti-discoloring agent and/or an UV absorbent.

14. The recording material for electrophotography according to claim 1, wherein said toner contains an anti-discoloring agent and/or an UV absorbent.

15. The recording material for electrophotography according to claim 1, wherein said resin comprises the same polymer as the resin constituting said toner.

16. The recording material for electrophotography according to claim 1, wherein said toner is prepared by milling the resin containing said coloring matter under a temperature of 0° C. or less.

17. The recording material for electrophotography according to claim 1, wherein said toner is prepared by a polymerization method.

18. An image recording method comprising forming an image on the recording medium for electrophotography constituting the recording material for electrophotography according to claim 1 by the toner that contains the coloring matter constituting said recording material for electrophotography, and fixing said coloring matter by means of the coloring matter-fixing agent contained in the toner-receiving layer.

19. The image recording method of claim 18 wherein said fixation is carried by heating.

20. A toner for electrophotography wherein said toner contains a coloring matter and a coloring matter-fixing agent capable of fixing the coloring matter.

21. A recording medium for electrophotography in which a toner-receiving layer containing a resin capable of fixing a coloring matter is placed on a support, wherein said medium contains a coloring matter-fixing agent capable of fixing said coloring matter in said toner-receiving layer.

* * * * *